US010798999B2

(12) United States Patent
Reil et al.

(10) Patent No.: US 10,798,999 B2
(45) Date of Patent: Oct. 13, 2020

(54) OVERHANGING JAW CARTRIDGE FOR BODY PIERCING INSTRUMENT

(71) Applicant: Goran Reil, Gardena, CA (US)

(72) Inventors: Vladimir Reil, Rancho Palos Verdes, CA (US); Goran Reil, Las Vegas, NV (US)

( * ) Notice: Subject to any disclaimer, the term of this patent is extended or adjusted under 35 U.S.C. 154(b) by 115 days.

(21) Appl. No.: 15/611,658

(22) Filed: Jun. 1, 2017

(65) Prior Publication Data

US 2018/0343988 A1 Dec. 6, 2018

(51) Int. Cl.
*A44C 7/00* (2006.01)

(52) U.S. Cl.
CPC ..... *A44C 7/001* (2013.01)

(58) Field of Classification Search
CPC ..... A44C 7/001; A44C 7/00; A44C 7/003
See application file for complete search history.

(56) References Cited

U.S. PATENT DOCUMENTS

| | | | | |
|---|---|---|---|---|
| 4,030,507 | A * | 6/1977 | Mann | A44C 7/001 606/188 |
| 4,146,032 | A | 3/1979 | Rubenstein et al. | |
| 4,474,572 | A | 10/1984 | McNaughton et al. | |
| 4,527,563 | A | 7/1985 | Reil | |
| 5,004,471 | A | 4/1991 | Mann | |
| 5,263,960 | A | 11/1993 | Mann | |
| 5,389,105 | A | 2/1995 | Mann | |
| 5,395,381 | A | 3/1995 | Green et al. | |
| D366,316 | S | 1/1996 | Reil | |
| 5,496,343 | A | 3/1996 | Reil | |
| 5,499,993 | A | 3/1996 | Blomdahl et al. | |
| D384,302 | S | 9/1997 | Reil | |
| 5,709,700 | A | 1/1998 | Hirota | |
| D392,042 | S | 3/1998 | Reil | |
| 5,792,170 | A | 8/1998 | Reil | |
| 5,868,774 | A | 2/1999 | Reil | |
| 5,913,869 | A | 6/1999 | Reil | |

(Continued)

FOREIGN PATENT DOCUMENTS

EP 0415777 A1 3/1991

OTHER PUBLICATIONS

PCT International Search Report and Written Opinion of International Application No. PCT/US2018/035316, dated Sep. 3, 2018.

*Primary Examiner* — Kathleen S Holwerda
*Assistant Examiner* — Brooke Labranche
(74) *Attorney, Agent, or Firm* — Canady & Lortz LLP; Bradley K. Lortz

(57) ABSTRACT

Apparatuses and systems for ornamental piercing of body parts are disclosed comprising a body piercing cartridge for use with a reusable body piercing instrument. The body piercing cartridge includes a feature for engaging a matching feature of the instrument coupled to the finger grip section of the of the instrument. The engaging feature of the jaw is disposed back from an end of the jaw such that the end of the jaw extends beyond a forward extension of the body piercing instrument to achieve an overhanging jaw. The overhanging jaw reduces the likelihood of contact by the body piercing instrument with the body which accordingly reduces the likelihood of infection. The overhanging jaw is particularly useful for making piercings without a clutch such as in a nostril.

20 Claims, 9 Drawing Sheets

(56) References Cited

U.S. PATENT DOCUMENTS

| | | | | |
|---|---|---|---|---|
| 6,036,712 | A | 3/2000 | Blomdahl | |
| 6,048,355 | A | 4/2000 | Mann et al. | |
| 6,074,406 | A | 6/2000 | Mann | |
| 6,099,545 | A | 8/2000 | Mann et al. | |
| 6,599,306 | B1 | 6/2003 | Reil | |
| 7,955,349 | B2 | 6/2011 | Reil | |
| 2006/0224173 | A1* | 10/2006 | Reil ..... | A44C 7/001<br>606/188 |

* cited by examiner

OVERHANGING JAW CARTRIDGE FOR BODY PIERCING INSTRUMENT

BACKGROUND OF THE INVENTION

1. Field of the Invention

The present invention relates to apparatuses and methods for ornamental piercing of body parts. Particularly, the present invention relates to apparatuses and methods for a cartridge for use with body piercing instrument.

2. Description of the Related Art

In recent years, body piercing has become an increasingly common practice in the U.S. and throughout the world. Although the piercing of body parts is ancient, the practice is rapidly becoming a routine procedure, often performed by laypersons without medical experience or training. It is also important to understand that mainstream body piercing has evolved to include piercing of body parts other than just the ear. For example, piercing of flesh near the naval or belly button, eyebrow, lip, etc., are much more common than previously. Presently, a number of manually operated devices are available that allow for the safe, hygienic, user-friendly piercing of body parts. Examples of such systems are disclosed in U.S. Pat. No. 5,496,343 by Reil, issued Mar. 5, 1996, U.S. Pat. No. 5,792,170 by Reil, issued Aug. 11, 1998, U.S. Pat. No. 5,868,774 by Reil, issued Feb. 9, 1999, U.S. Pat. No. 6,599,306 by Reil, issued Jul. 29, 2003, and U.S. Pat. No. 6,796,990 by Reil, issued Sep. 28, 2004, all of which are incorporated by reference herein.

In addition to piercing entirely by hand with a needle, there are a variety of body piercing systems available today. These various body piercing systems essentially comprise a stud (also called an earring or a piercing earring) which includes an affixed ornamental piece with a post (also called a stud, pin or a piercing pin) and a nut (sometimes called a clasp or clutch) that are mounted in a cartridge. The cartridge is employed with a body piercing instrument (a "gun-type" device) for supporting and operating the cartridge. During the piercing process, the body part (e.g., an ear lobe) is placed between the post and the nut and the cartridge is squeezed, either by hand or by operating it in a special body piercing system (or "gun," instrument or assembly), which causes the post to pierce the body part and engage the nut. Ideally, the body piercing instrument never contacts the body in use; only the cartridge contacts the body. Accordingly, the body piercing cartridge is typically disposable while the body piercing instrument is reusable.

In view of the foregoing, there is a need for apparatuses and systems that provide for simple, accurate, repeatable and safe body piercing. There is particularly a need for such methods and apparatuses that provide improved hygiene in use. Further, there is also a need for such methods and apparatuses to be functional in piercing performed without a nut or clutch. As discussed hereafter, the present invention meets these and other needs.

SUMMARY OF THE INVENTION

Apparatuses and systems for ornamental piercing of body parts are disclosed comprising a body piercing cartridge for use with a reusable body piercing instrument. The body piercing cartridge includes a feature for engaging a matching feature of the instrument coupled to the finger grip section of the of the instrument. The engaging feature of the jaw is disposed back from an end of the jaw such that the end of the jaw extends beyond a forward extension of the body piercing instrument to achieve an overhanging jaw. The overhanging jaw reduces the likelihood of contact by the body piercing instrument with the body which accordingly reduces the likelihood of infection. The overhanging jaw is particularly useful for making piercings without a clutch such as in a nostril.

A typical embodiment of the invention comprises a body piercing instrument cartridge including a main housing having a back edge for engaging a body piercing instrument, the body piercing instrument comprising a finger grip section and a palm grip section slidably engaged such that the back edge of the main housing engages a push support rigidly coupled to the palm grip section, a post holder supporting a post and slidably engaged with a post holder track within the main housing, and a jaw slidably engaged with the main housing with a jaw track, the jaw track parallel to the post holder track, and the jaw includes a feature for engaging a matching feature rigidly coupled to the finger grip section of the body piercing instrument where the feature of the jaw is disposed back from an end of the jaw such that the end of the jaw extends beyond a forward extension from the finger grip section of the body piercing instrument. The jaw supports a backing platform for piercing a body part with the post as the jaw and main housing are moved together along the jaw track by pressure applied between the finger grip section engaging the feature with the matching feature of the body piercing instrument and the palm grip section engaging back edge of the main housing with the push support of the body piercing instrument. Typically, the forward extension from the finger grip section can be tapered to a blunt point. In addition, the blunt point of the forward extension comprises a lip such that the feature of the jaw comprises a transverse slot and the matching feature of the finger grip section comprises the lip.

In some embodiments, the post holder can includes separate portions held together to support the post while slidably engaged with the post holder track within the main housing such that the separate portions fall away to release the post after exiting the post holder track. In some cases, the post can comprise a conical barb for clutchless piercing.

The body piercing instrument can comprise a spring disposed between the finger grip section and the palm grip section to oppose to moving the jaw and main housing together after the back edge of the main housing engages the push support of the palm grip section and the feature of the jaw engages the matching feature of the finger grip section. The jaw can include a push catch for sliding past the post holder as the jaw and main housing are moved together during piercing to engage a back end of the post holder and push the post holder out of the post holder track as the spring forces the jaw and main housing apart after piercing.

The backing platform can comprise a surface for supporting a user body part in an area around a back side of a piercing location and a hole therethough aligned with the post. The hole therethough can be vertically elongated to accommodate some vertical movement by the post during piercing. In some embodiments, the backing platform houses a clutch disposed in a vertical slot to engage the post during piercing and then slide out of the vertical slot. The finger grip section and the palm grip section each can comprise a series of bumps or ridges for improving grip.

A typical method embodiment of the invention, comprises a method of piercing a body part, including the steps of engaging a back edge of a main housing of a body piercing cartridge with a push support of a body piercing instrument, where the body piercing instrument comprises a finger grip section slidably engaged with a palm grip section and the push support is rigidly coupled to the palm grip section and where the body piercing cartridge comprises a jaw slidably engaged with the main housing in a jaw track and a post holder supporting a post is slidably engaged in a post holder track within the main housing, the jaw track being parallel to the post holder track, engaging a feature on the jaw of the body piercing cartridge with a matching feature rigidly coupled to the finger grip section of the body piercing instrument where the feature of the jaw is disposed back from an end of the jaw such that the end of the jaw extends beyond a forward extension from the finger grip section of the body piercing instrument, disposing a body part against a backing platform of the jaw with the body part between the jaw and the post, disposing one or more fingers of a user's hand across the finger grip section of the body piercing instrument, disposing a palm of the user's hand across the palm grip section of the body piercing instrument, and applying pressure between the palm and the one or more fingers in order to cause pressure between the finger grip section engaging the feature with the matching feature of the body piercing instrument and the palm grip section engaging back edge of the main housing with the push support of the body piercing instrument to move the jaw and the main body of the cartridge together along the jaw track such that a post pierces the body part against the backing platform of the jaw. The method embodiment of the invention can be modified consistent with any of the apparatuses or systems described herein.

A system embodiment of the invention comprises a body piercing cartridge including a main housing, a jaw slidably engaged with the main housing with a jaw track, and a post holder supporting a post and slidably engaged with the main housing with a post holder track, the jaw track parallel to the post holder track, and a body piercing instrument including a finger grip section and a palm grip section slidably engaged where a push support is rigidly coupled to the palm grip section of the body piercing instrument. The jaw includes a feature for engaging a matching feature rigidly coupled to the finger grip section of the body piercing instrument and the feature of the jaw is disposed back from a front end of the jaw such that the front end of the jaw extends beyond a forward extension from the finger grip section of the body piercing instrument. The jaw supports a backing platform for piercing a body part with the post as the jaw and main housing are moved together along the jaw track by pressure applied between the finger grip section engaging the feature with the matching feature of the body piercing instrument and the palm grip section engaging back edge of the main housing with the push support of the body piercing instrument. The system embodiment of the invention can be modified consistent with any of the apparatuses or methods described herein.

BRIEF DESCRIPTION OF THE DRAWINGS

Referring now to the drawings in which like reference numbers represent corresponding parts throughout.

DETAILED DESCRIPTION OF THE PREFERRED EMBODIMENT

In the following description including the preferred embodiment, reference is made to the accompanying drawings which form a part hereof, and in which is shown by way of illustration specific embodiments in which the invention may be practiced. It is to be understood that other embodiments may be utilized and structural changes may be made without departing from the scope of the present invention.

1.0 Disposable Hand Operated Cartridge Body Piercing Instrument

As mentioned above, various embodiments of the invention are designed to be used with and encompass a body piercing cartridge for ornamental piercing of body parts. Embodiments of the invention are particularly suited for piercing of the nose, although they can be employed in piercing almost any body part as will be understood by those skilled in the art. Embodiments of the invention provide a compact and disposable cartridge to be installed in and used with a body piercing instrument that is hand operated. Typically, the cartridge comes in a sealed sterilized package. The cartridge is pre-loaded with the post (which includes a stud ornament) so that it can be readily operated to create a body part piercing and then discarded. The body piercing instrument may be reused with a new cartridge.

Figure 1A:
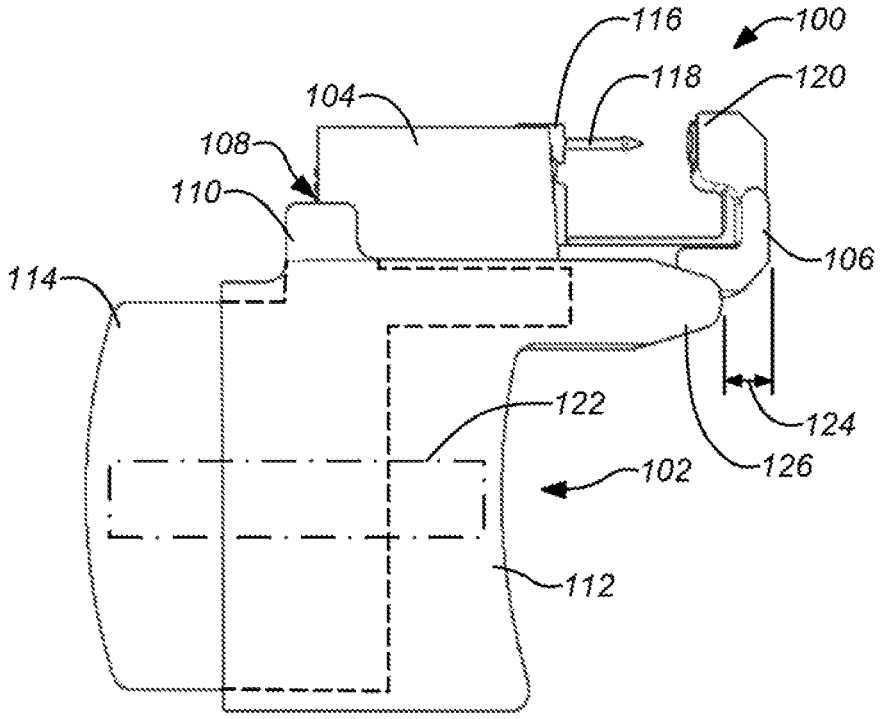
FIG. 1A illustrates a side view of an exemplary body piercing cartridge and body piercing instrument in an embodiment of the invention.
Figure 1B:
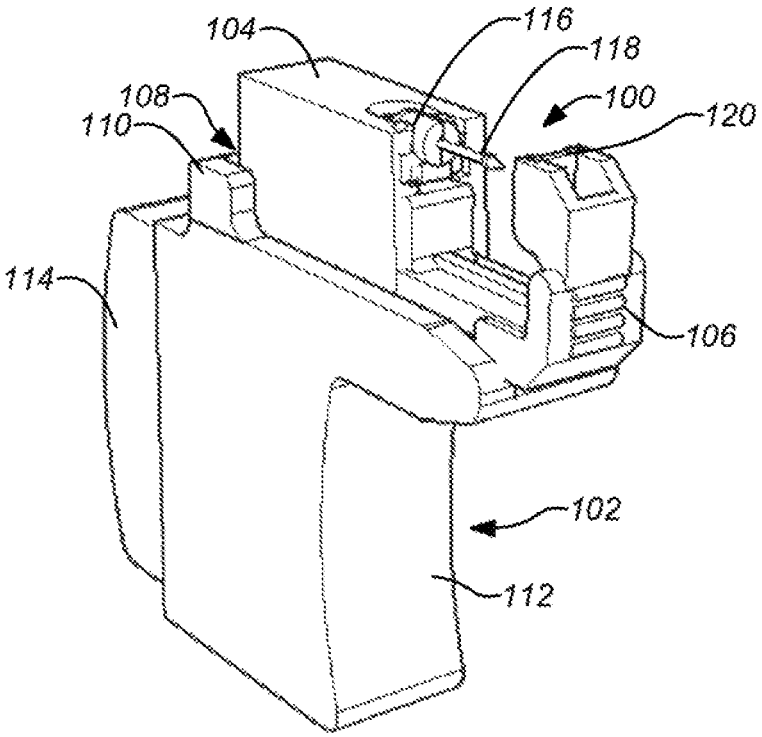
FIG. 1B illustrates an isometric view of an exemplary body piercing cartridge and body piercing instrument in an embodiment of the invention.

FIGS. 1A and 1B illustrate side and isometric views of an exemplary body piercing cartridge and body piercing instrument in an embodiment of the invention. FIG. 1A shows the body piercing instrument cartridge 100 installed in the body piercing instrument 102 prior to actuation. The body piercing cartridge 100 includes a main housing 104 and a jaw 106 slidably engaged with each other. A back edge 108 of the main housing 104 engages a push support 110 of the body piercing instrument 102. The body piercing instrument 102 includes a finger grip section 112 and a palm grip section 114 also slidably engaged. A portion of the palm grip section 114 is enclosed within the finger grip section 112 as indicated by the dotted line of FIG. 1A. The push support 110 is rigidly coupled to the palm grip section 114 of the body piercing instrument 102 and disposed to extend from the interior of the top of the finger grip section 112. An instrument spring 122 (compression spring) is disposed between the interiors of the palm grip section 114 and the finger grip section 112 to oppose pressure from the user's hand and return the instrument to and open position when pressure is released. Alignment of the spring 122 can be secured by a post and/or socket affixed to either or both the interiors of the palm grip section 114 and the finger grip section as will be understood by those skilled in the art.

As previously mentioned, one important feature of embodiments of the invention is that the end of the jaw 106 extends beyond a forward extension 126 from the finger grip section 112 of the body piercing instrument 102. In other words, the jaw 106 overhangs the end of the forward extension 126 by an overhang distance 124. This overhang reduces the likelihood of contact with the body of the person being pierced which correspondingly reduces the likelihood of infection allowing the piercing instrument 102 to be reusable. To further reduce the likely of contact, the forward extension 126 from the finger grip section 112 can also be tapered to a blunt point as shown.

Engagement of the cartridge 100 with the instrument 102 is secured between the back edge 108 of the main housing 104 of the cartridge 100 and a feature on the bottom of the jaw 106. The back edge 108 can include a horizontal groove (or slot) which engages a lip within the push support 110 pocket. (Detail is shown hereafter in FIGS. 6A and 6B and FIGS. 8A and 8B.) The feature on the bottom of the jaw 106 can similarly comprise a horizontal groove (or slot) which engages a lip at the end of the forward extension 126 of the finger grip section 122. (Detail is shown hereafter in FIGS. 7A to 7C and FIGS. 8A and 8B.)

Figure 3B:
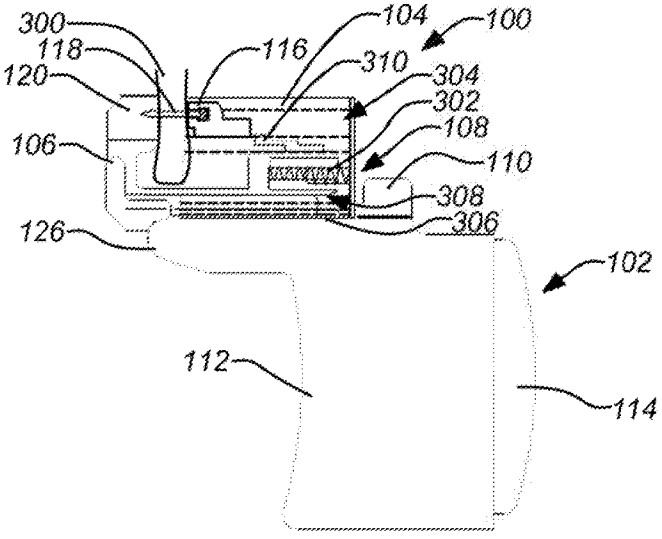
FIG. 3B illustrates a cross section view of an exemplary body piercing cartridge embodiment of the invention in use compressed to pierce a body part.
Figure 3A:
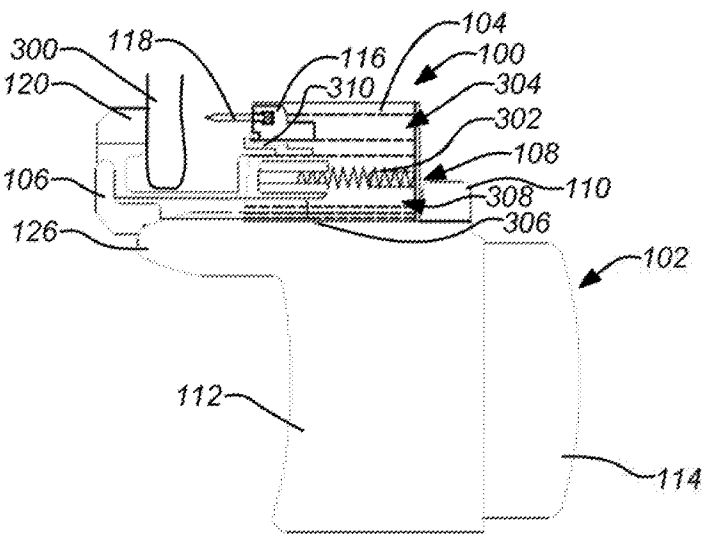
FIG. 3A illustrates a cross section view of an exemplary body piercing cartridge embodiment of the invention prepared for use.
Figure 3C:
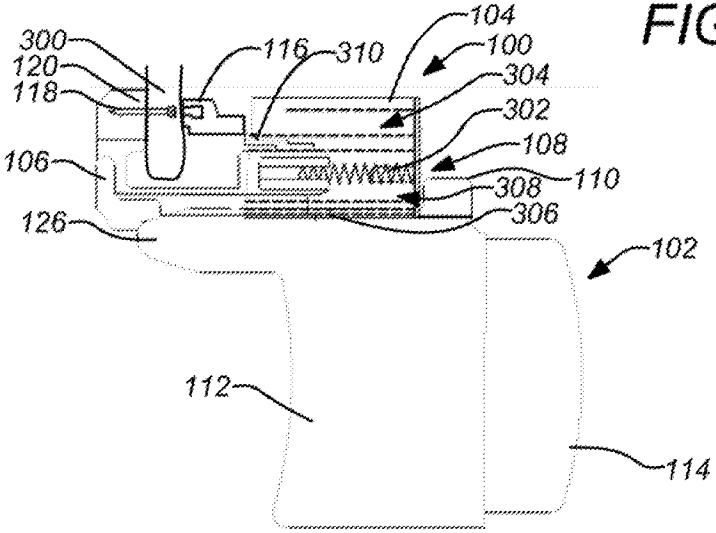
FIG. 3C illustrates a cross section view of an exemplary body piercing cartridge embodiment of the invention in use released to eject the post holder.

FIG. 1B illustrates an isometric view of an exemplary body piercing cartridge 100 and body piercing instrument 102 in an embodiment of the invention. Within the cartridge, a post holder 116, which supports a post 118, is slidably engaged with a post holder track within the main housing 104. Similarly, the jaw 106 is slidably engaged with a jaw track within the main housing 104. The jaw track is parallel to the post holder track. The jaw 106 supports a backing platform 120 for piercing a body part with the post 118 as the jaw 106 and main housing 104 are moved together along the jaw track. Movement to compress the jaw 106 and main body 104 can be opposed by a compression spring disposed within and between these two components. (Detail is shown in FIGS. 3A to 3C.) When the cartridge 100 is engaged in the instrument 102, movement between the finger grip section 112 and the palm grip section 114 of the instrument 102 is also parallel to that of the jaw 106 and post holder 116.

Typically, embodiments of the invention can be produced from injection molded plastic materials that can be sterilized although any other suitable material is also possible. Any of the separate moldings for the main housing 104, jaw 106, and post holder 116 can be formed from opaque plastic. However, it is desirable to mold the post holder 116 from clear plastic so that the stud ornament can be seen within the post holder 116 prior to use of the cartridge 100. Although it is also possible to produce a disposable hand operated cartridge body piercing instrument embodiment of the invention from machined materials, e.g. metals, molded materials are preferred because they can be produced inexpensively, a priority for any disposable product. Embodiments of the invention are preferably provided in a sealed sterilized bubble package such that the device is used one time to provide a piercing with the pre-installed post and then discarded.

Figure 2A:
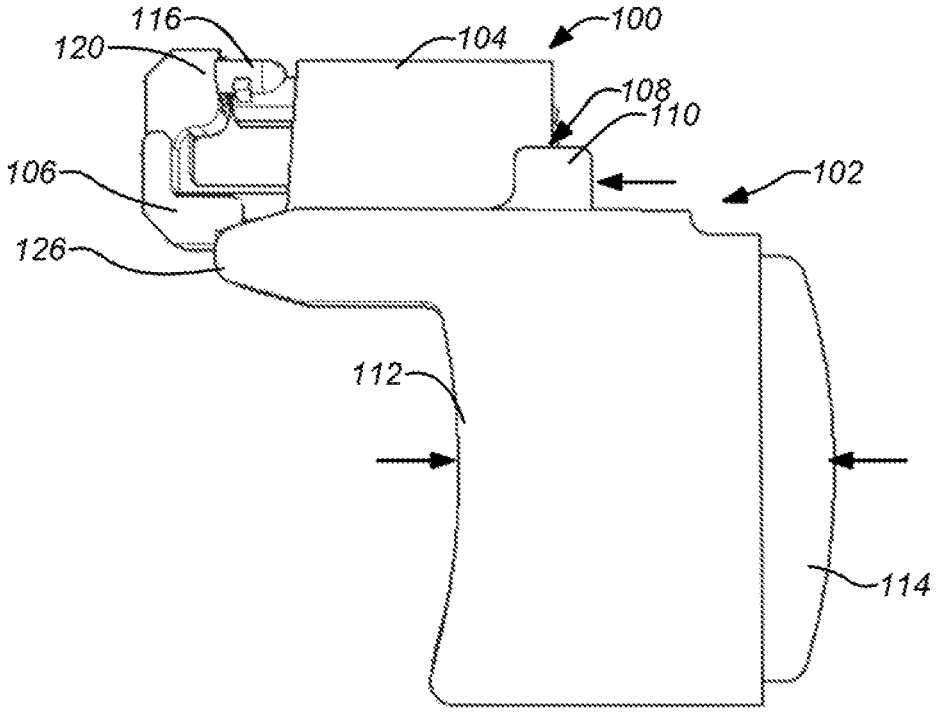
FIG. 2A illustrates a side view of an exemplary body piercing cartridge and body piercing instrument in an embodiment of the invention showing the instrument compressed.
Figure 2B:
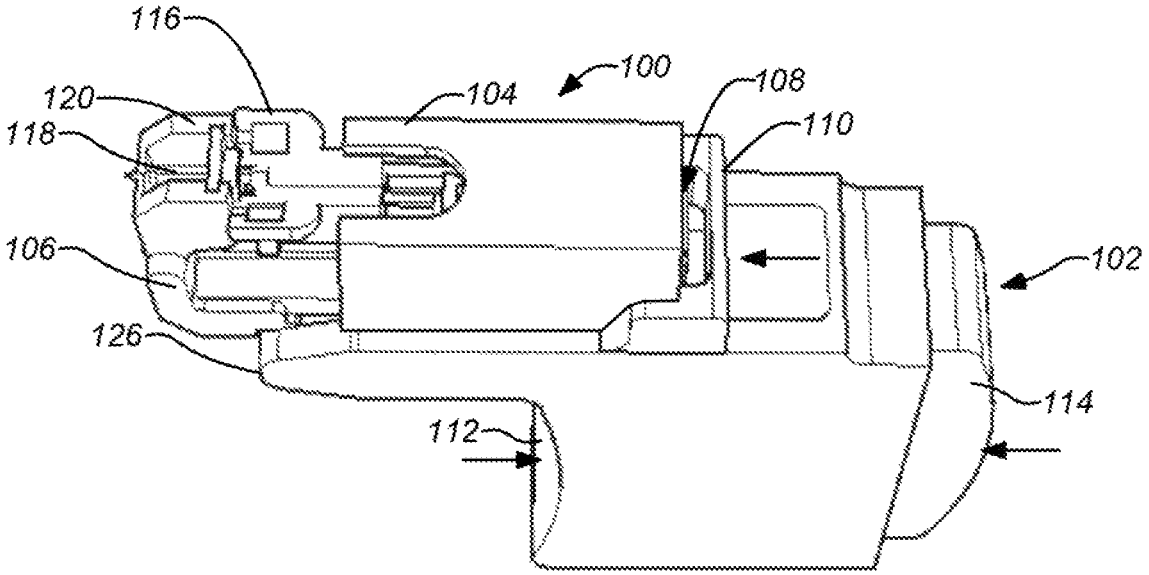
FIG. 2B illustrates a top view of an exemplary body piercing cartridge and body piercing instrument in an embodiment of the invention showing the post carrier open after piercing.
Figure 2C:
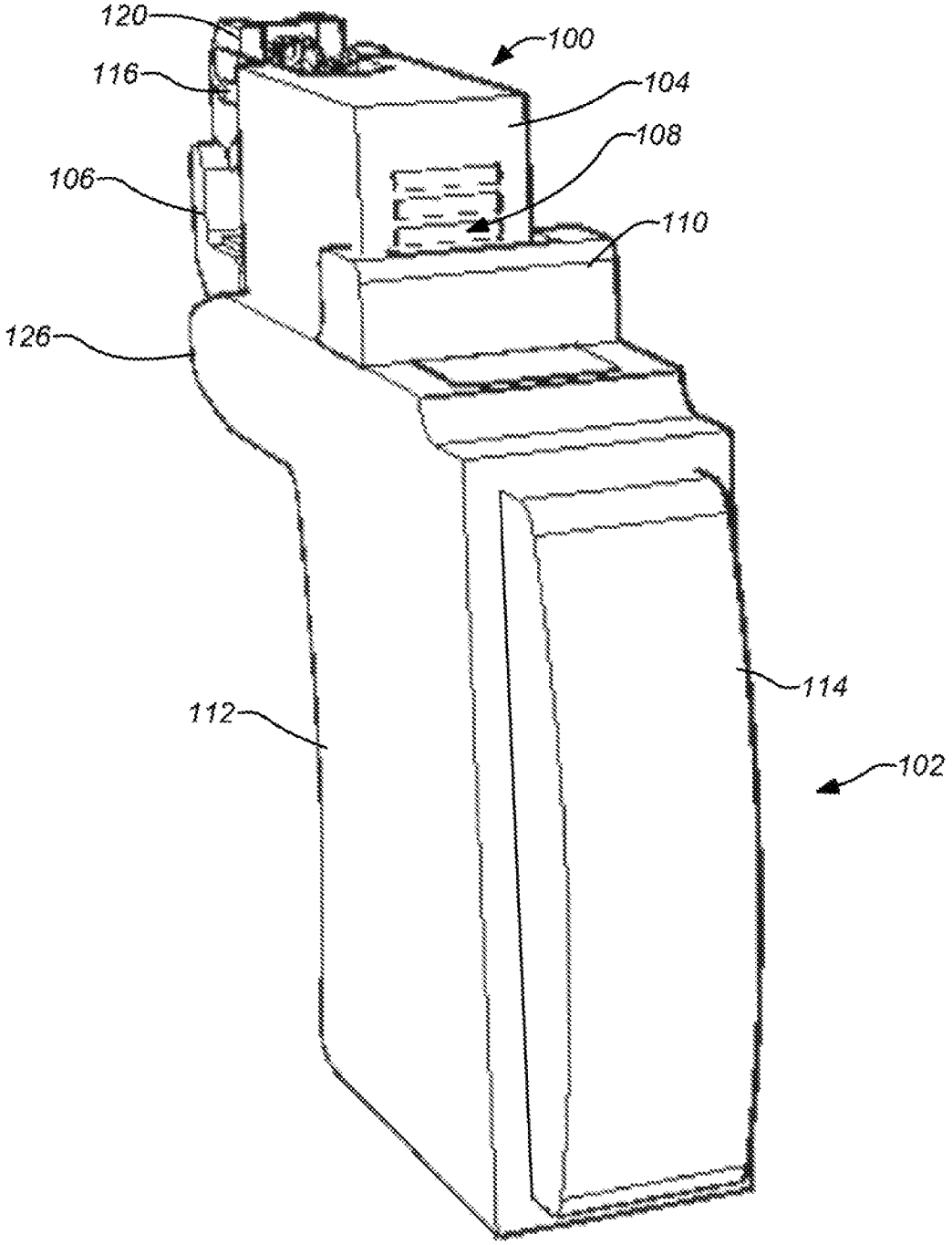
FIG. 2C illustrates a rear view of an exemplary body piercing cartridge and body piercing instrument in an embodiment of the invention showing the instrument compressed.

FIG. 2A to 2C illustrate various views of an exemplary body piercing cartridge 100 and body piercing instrument 102 in an embodiment of the invention showing the body piercing instrument compressed (which thereby compresses the cartridge 100). Compression is achieved by one or more user's fingers being placed across the finger grip section 112 and the user's palm (or alternately thumb) of the same hand being place across the palm grip section 114 and pressure being applied between finger grip section 112 and the palm grip section 114 by the user as indicated by the arrows. This action causes the palm grip section 114 to be forced into the finger grip section 112 and thereby move the move the push support 110, which is rigidly coupled to the palm grip section, the same distance (along the indicate arrow).

FIGS. 3A to 3C illustrate a cross section views of an exemplary body piercing cartridge embodiment of the invention at different stages of operation. The user first engages the body piercing cartridge 100 into the body piercing instrument 102. Next, the user positions a body part 300 (of another) against the backing platform 120. Applying pressure with the user's hand to the instrument 102 as previously described causes the jaw 106 and the main body 104 of the cartridge 100 to be moved together, which in turn causes the post 118 to pierce the body part 300. Following this, the user's hand is released allowing pressure from the spring 302 to cause the jaw 106 and the main body 104 to separate, which in turn causes the post 118 to be released from the post holder 116 and remain pierced through the body part 300. (The spring 122 shown in FIG. 1A within the instrument 102 also aids in separating the jaw 106 and main body 104 along with separating the finger grip section 112 and the palm grip section 114.)

FIG. 3A illustrates a cross section view of the disposable body piercing cartridge 100 prepared for use. As shown, the post 118 is supported within the post holder 116 which is within the post holder track 304 of the main housing 104. A body part 300, e.g. an ear lobe, a nostril, navel flap, etc., is positioned against the backing platform 120 of the jaw 106. The jaw 106 is slidably engaged in the jaw track 304 of the main housing 104. A spring 302 is disposed within the main housing 104 forcing the main housing 104 and jaw 106 apart to oppose to moving the jaw 106 and main housing 104 together. A catch 306 attached to the jaw 106 and latched against an edge within the main housing 104 prevents the jaw 106 from being forced out of the jaw track 308 of the main housing 104 by the spring 302 force.

FIG. 3B illustrates a cross section view of an exemplary body piercing cartridge 100 embodiment of the invention operated with a body piercing instrument 102 compressed to pierce a body part 120. To achieve this, one or more fingers, e.g. the index finger, of a user's hand are positioned across the finger grip section 112 of the instrument 102 while the palm or thumb of the user's hand is positioned across a palm grip section 114 of the instrument 102. Pressure is applied between the palm/thumb and one or more fingers to cause the jaw 106 and the main body 104 to move together along the jaw track 308 such that a post 118 pierces the body part 300 against the backing platform 120 of the jaw 106. The sharpened end of the post 118 enters the hole in the backing platform 120 of the jaw 106 after piercing the body part 300. The spring 302 is compressed against the pressure of the user's hand forcing the jaw 106 and main body 104 together. In addition, a push catch 310, having cantilever spring configuration with a rising slope, is attached to the jaw 106 and has moved back past the post holder 116 and popped up behind it.

FIG. 3C illustrates a cross section view of an exemplary body piercing cartridge 100 embodiment of the invention operated with a body piercing instrument 102 released to eject the post holder 116. As the user's hand is released, pressure from the spring 302 forces the jaw 106 and main body 104 apart. As the jaw 106 moves along the jaw track 308 under force from the spring 302, the push catch 310, having previously popped up behind the post holder 116, now pushes the post holder 116 forward and out of the post holder track 304. The post holder 116 comprises two parts which are held together to enclose and support the post 118 only while it is within the post holder track 304 as described in detail hereafter. Once the post holder 116 exits the track 304, the two parts of the post holder 116 separate and release the post 118 pierced through the body part 300.

2.0 Post Holder and Post with Conical Barb

Embodiments of the invention employ a post 118 supported by a post holder 116 slidably engaged with a post holder track 304 within the main housing 104. Preferably, the post holder 116 comprises separate portions which are held together as long as the post holder 116 is slidably engaged by the walls of the post holder track 304, but fall away to release the post 118 after exiting the post holder track 304. For example, the separate portions can comprise two halves 402A, 402B each having half a socket 406A, 406B for the stud ornament of the post 118 which mate together fully enclosing the stud ornament of the post 118 and allowing the sharpened post end to extend from the post holder 116. In addition, the two halves can be further aligned together by a pin 404A on one half and a matching socket 404B on the other that engage one another when assembled around the post 118.

Figure 4A:
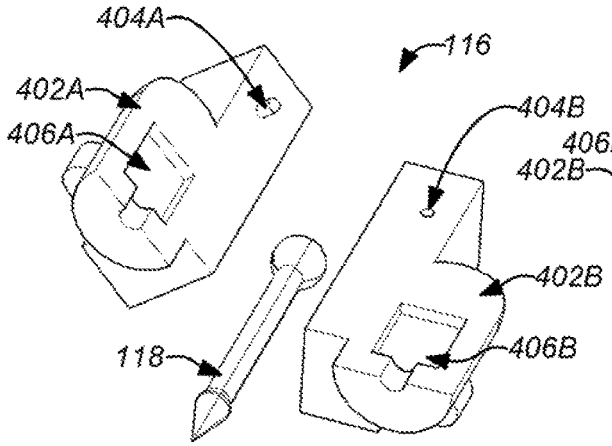
FIG. 4A illustrates a front isometric view of an exemplary post holder for use in a hand operated body piercing cartridge embodiment of the invention.
Figure 4B:
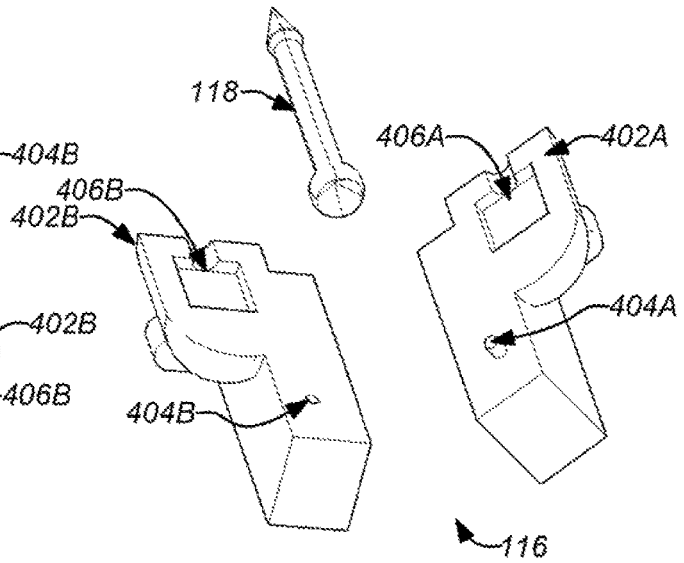
FIG. 4B illustrates a back isometric view of an exemplary post holder for use in a hand operated body piercing cartridge embodiment of the invention.

FIGS. 4A and 4B illustrate isometric views of an exemplary post holder 106 for use in a body piercing cartridge 100 embodiment of the invention. The separate halves 402A, 402B divide along a vertical plane such that each half 402A, 402B comprises a half socket 406A, 406B for the supporting the post 118 when they are coupled together within the post holder track 304 of the main housing 104. To assist in alignment of the two halves 402A, 402B when they are coupled together a matching pin 404A and hole 404B are disposed on each of two halves 402A, 402B on the vertical plane where they separate. The pin 404A and hole 404B can be disposed on either the left and right or right and left sides of the post holder 116.

Figure 5A:
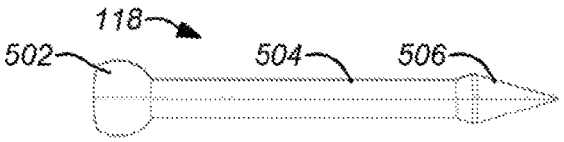
FIG. 5A illustrates a side view of an exemplary conical barb post for use with a body piercing cartridge embodiment of the invention.
Figure 5B:
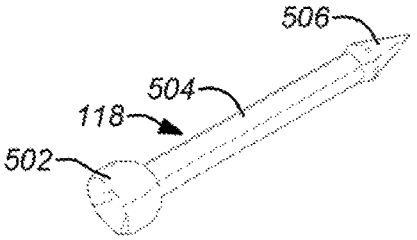
FIG. 5B illustrates a rear isometric view of an exemplary conical barb post for use with a body piercing cartridge embodiment of the invention.
Figure 5C:
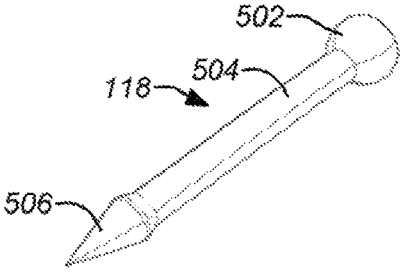
FIG. 5C illustrates a front isometric view of an exemplary conical barb post for use with a body piercing cartridge embodiment of the invention.

FIGS. 5A to 5C illustrate various views of an exemplary conical barb post for use with a body piercing cartridge 100 embodiment of the invention. Cartridge 100 embodiments of the invention can employ any suitable post 118 design. The post 118 includes an ornament 502 at one end which is enclosed in the socket formed by the half sockets 406A, 406B of the post holder 116. The half sockets 406A, 406B also form a channel which supports the shaft 504 of the post 118 which extends out of the post holder 116 towards the backing platform 120 of the jaw 106.

The point 506 at the opposite end of the shaft 504 can be any suitable form of sharpened end. For example, the point 506 can comprise a cannula form, a conical point, a barb or any other known point for body piercing. In one notable example, the point 506 comprises a conical barb comprising a pointed conical end which flares to a diameter wider than the shaft 504 diameter. An inverted conical section (having the same taper angle as the pointed conical end) reverses the diameter from the widest diameter to the shaft 504 diameter. This conical barb shape allows a body piercing to be formed, e.g. through a nostril, and remain in place without requiring a clutch to secure the pointed end. The widened conical barb prevents the post from falling out in a clutchless piercing.

3.0 Main Housing Tracks

Figure 6A:
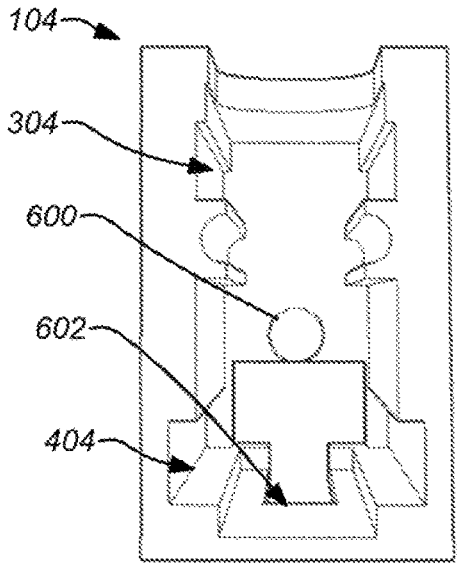
FIG. 6A illustrates a front isometric view of an exemplary main housing for use in a body piercing cartridge embodiment of the invention.
Figure 6B:
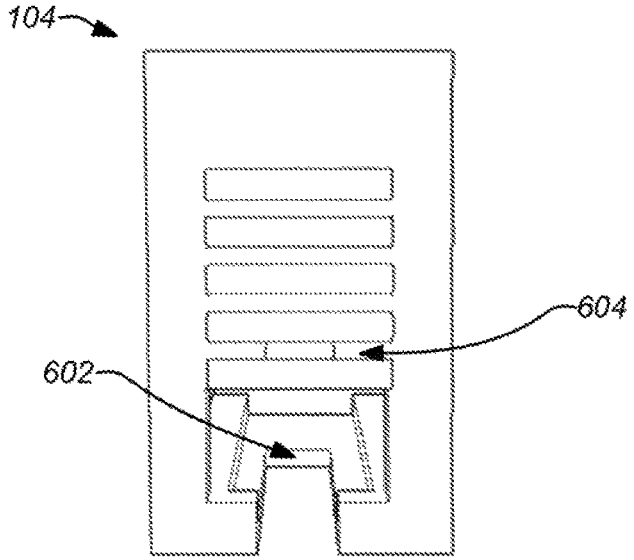
FIG. 6B illustrates a back isometric view of an exemplary main housing for use in a body piercing cartridge embodiment of the invention.

FIGS. 6A and 6B illustrate various views of an exemplary main housing 104 for use in a body piercing cartridge 100 embodiment of the invention. The main housing 104 includes the post holder track 304 and the jaw track 308. It should be noted that shapes of the post holder track 304 and the jaw track 308 can be varied. It is only necessary that they present projected cross sections matching the respective element portions, i.e. the post holder 116 and the jaw 106, that they receive to provide slidable engagement therewith.

As previously mentioned, the jaw 106 also includes a catch 306 for holding the jaw 106 engaged in the jaw track 308 of the main housing 104 against the spring 302 forcing the jaw 106 and the main housing 104 apart. The catch 306 is designed to engage a horizontal edge 602 at the bottom of the jaw track 308 disposed at the position of the catch 306 shown in FIG. 3C. In addition, the main housing 104 also includes a spring engagement pin 600 for securing the cylindrical compression spring 302 in position when the cartridge 100 is assembled. This matches the spring engagement socket 706 of the jaw 106 described hereafter.

In addition, as previously mentioned, engagement of the cartridge 100 with the instrument 102 is secured between the back edge 108 of the main housing 104 of the cartridge 100 and a feature on the bottom of the jaw 106. The back edge 108 of the main housing 104 includes a horizontal groove (or slot) 604 which engages a lip 800 within the push support 110 pocket. See also FIGS. 8A and 8B.

4.0 Jaw and Backing Platform

Figure 7A:
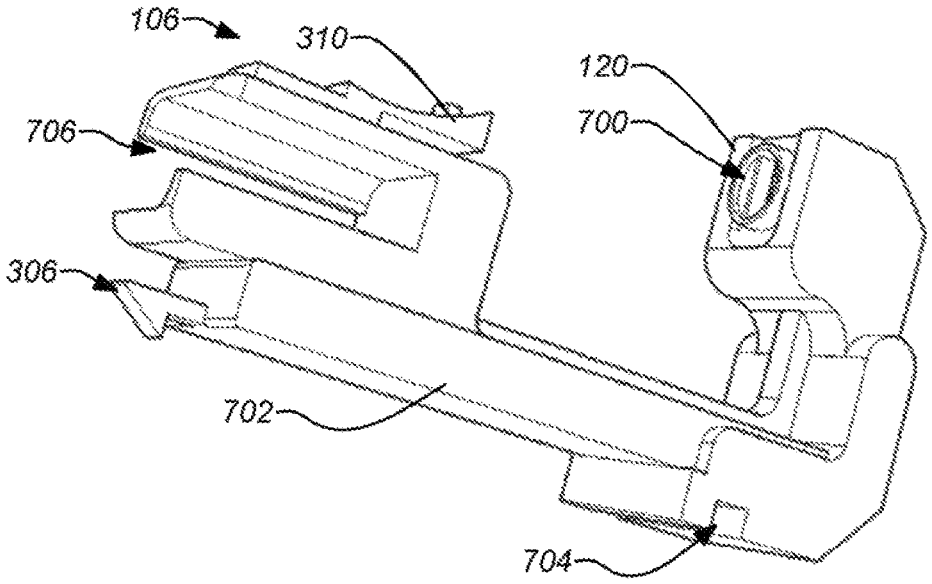
FIG. 7A illustrates a low rear isometric view of an exemplary jaw for use in a body piercing cartridge embodiment of the invention.
Figure 7C:
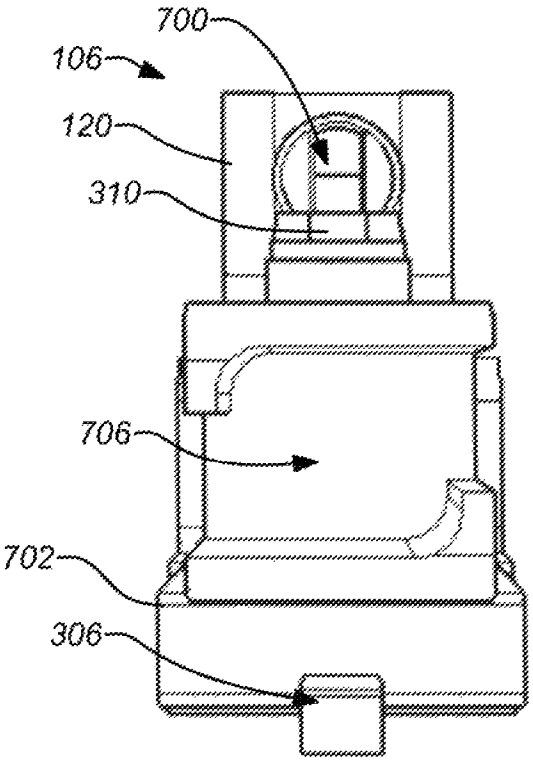
FIG. 7C illustrates a rear view of an exemplary jaw for use in a body piercing cartridge embodiment of the invention.
Figure 7B:
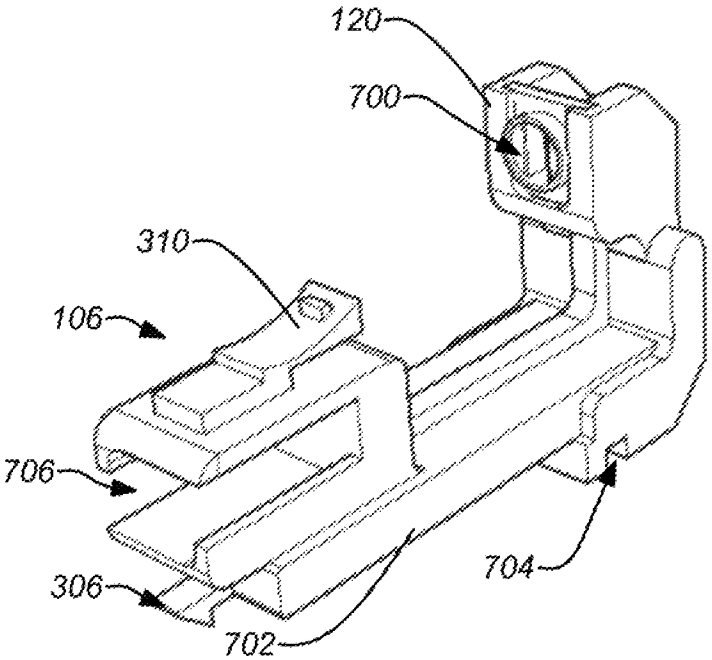
FIG. 7B illustrates a rear isometric view of an exemplary jaw for use in a body piercing cartridge embodiment of the invention.

FIGS. 7A to 7C illustrate various views of an exemplary jaw for use in a hand operated body piercing cartridge embodiment of the invention. The backing platform 120 can comprise a surface for supporting a user body part in an area around a back side of a piercing location and hole 700 therethough aligned with the post 118. The hole 700 therethough can be vertically elongated to accommodate some vertical movement by the post 118 during piercing. The backing platform 120 can alternately house a clutch disposed in a vertical slot to engage the post during piercing and then slide out of the vertical slot. In some instances, the jaw 106 can include a reinforcing beam or stiffener 702 disposed behind the instrument engagement feature 704 to stabilize movement of the jaw 106 and main body 104 during piercing.

Significantly, the jaw 106 can include a push catch 310 for sliding past the post holder 116 as the jaw 106 and main housing 104 are moved together during piercing to engage a back end of the post holder 116. The push catch 310 then pushes the post holder 116 out of the post holder track 304 as the spring 302 forces the jaw 106 and main housing 104 apart after piercing.

As previously mentioned, the jaw 106 includes a feature 704 for engaging a matching feature of the body piercing instrument 102 to engage the cartridge 100 with the instrument 102. In one example, the feature on the bottom of the jaw 106 can comprise a horizontal groove (or slot) 704 which engages a lip 802 at the end of the forward extension 126 of the finger grip section 122. See also FIGS. 8A and 8B. It should be noted that those skilled in the art will recognize that many different types of known mechanical engagement features can be employed within the scope of the invention to engage both the main body 104 with the push support 110 as well as the jaw 106 with the forward extension 126. Ideally, the engagement of these two pairs of elements is easily made by hand with a snap fit such that the cartridge 100 will not fall out of the instrument 102 but can be removed with only mild force.

5.0 Body Piercing Instrument

Figure 8A:
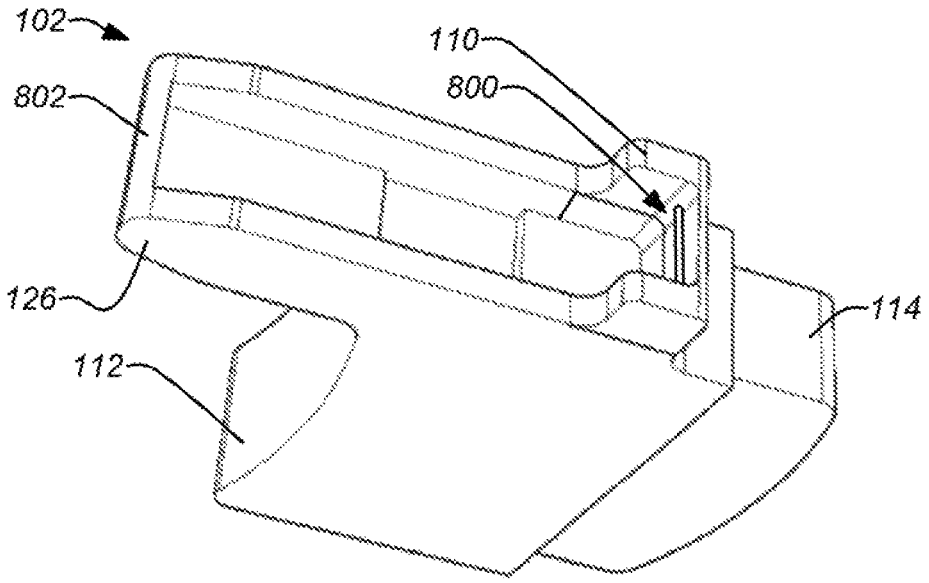
FIG. 8A illustrates a top isometric view of an exemplary body piercing instrument for use with a body piercing cartridge embodiment of the invention.
Figure 8B:
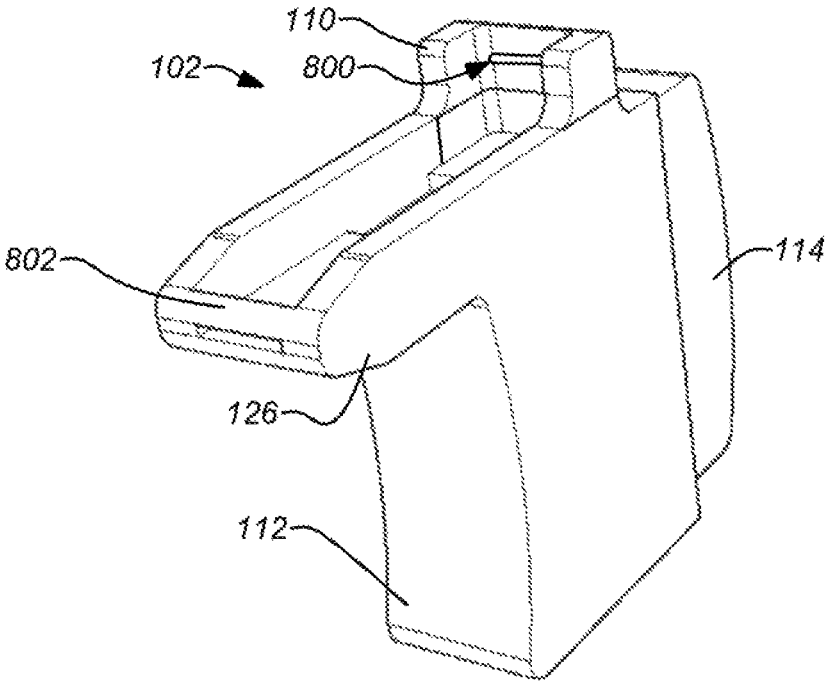
FIG. 8B illustrates a rear isometric view of an exemplary body piercing instrument for use with a body piercing cartridge embodiment of the invention.

FIGS. 8A and 8B illustrate different views of an exemplary body piercing instrument 102 for use with a body piercing cartridge 100 embodiment of the invention. The body piercing instrument 102 includes a slidably engaged finger grip section 112 and palm grip section 114. The push support 110 is rigidly coupled to the palm grip section 114 of the body piercing instrument 102 and disposed to extend from the interior of the top of the finger grip section 112. In this example, the blunt point of the forward extension 126 can comprise a lip 802 as the matching feature to engage the feature of the jaw 106. Thus, the feature of the jaw 106 can comprise a transverse slot 704 and the matching feature of the finger grip section 112 comprises the lip 802 which engages the slot 704 when the cartridge 100 is installed in the instrument. At the same time, the main body 104 comprises a horizontal groove (or slot) 604 at the back edge 108 which engages a lip 800 within the push support 110 pocket of the instrument 102.

6.0 Overhanging Body Piercing Cartridge Method

Figure 9:
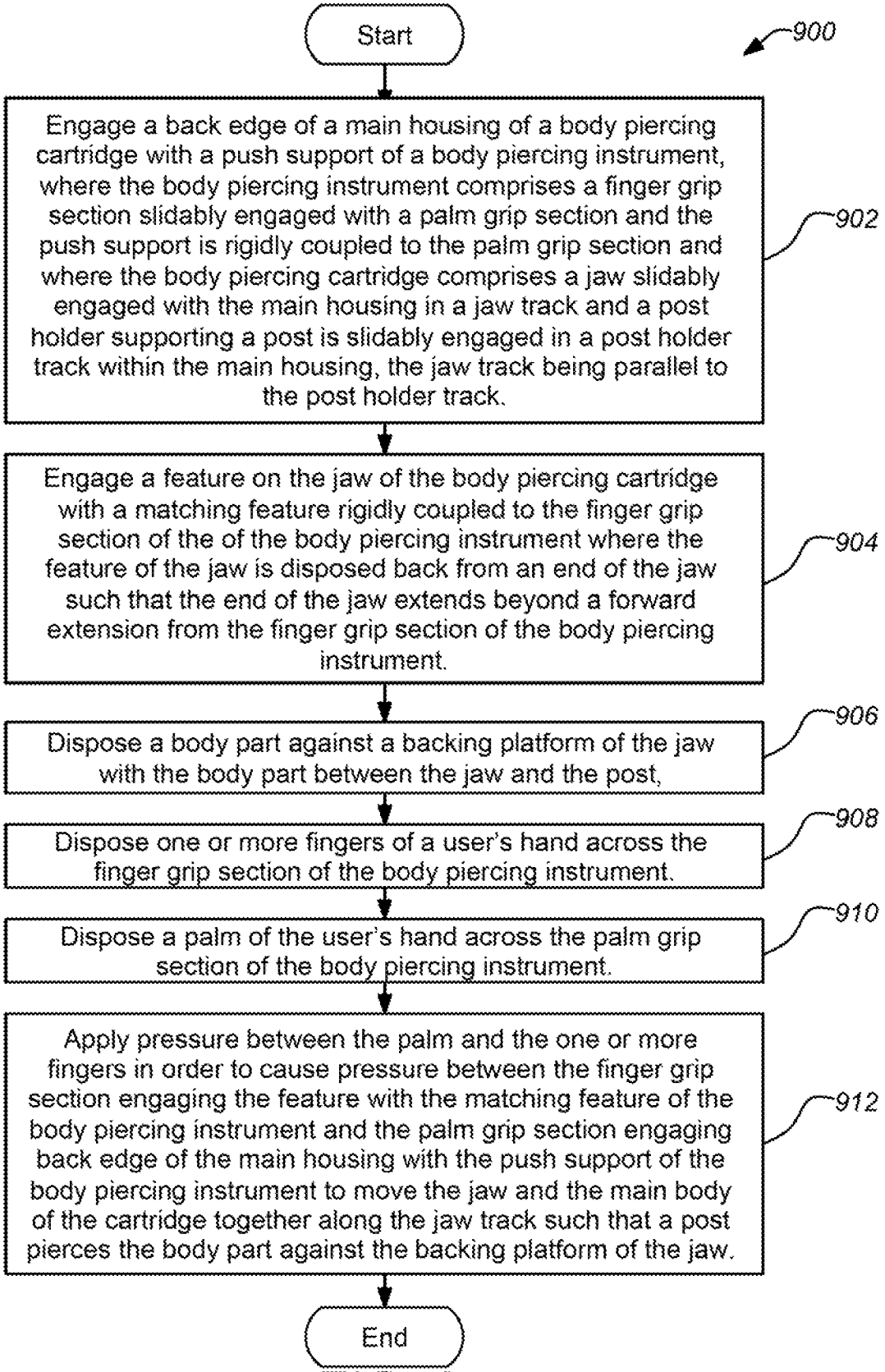
FIG. 9 is a flowchart of an exemplary method of operating a body piercing system embodiment of the invention.

FIG. 9 is a flowchart of an exemplary method of operating a body piercing cartridge embodiment of the invention. The method 900 begins with the step 902 of engaging a back edge of a main housing of a body piercing cartridge with a push support of a body piercing instrument. The body piercing instrument comprises a finger grip section slidably engaged with a palm grip section and the push support is rigidly coupled to the palm grip section. In addition, the body piercing cartridge comprises a jaw slidably engaged with the main housing in a jaw track and a post holder supporting a post is slidably engaged in a post holder track within the main housing, the jaw track being parallel to the post holder track. In step 904, a feature on the jaw of the body piercing cartridge is engaged with a matching feature rigidly coupled to the finger grip section of the of the body piercing instrument. The feature of the jaw is disposed back from an end of the jaw such that the end of the jaw extends beyond a forward extension from the finger grip section of the body piercing instrument. Next, in step 906 a body part is disposed against a backing platform of the jaw with the body part between the jaw and the post. In step 908, one or more fingers of a user's hand are disposed across the finger grip section of the body piercing instrument. In step 910, a palm (or thumb) of the user's hand across is disposed the palm grip section of the body piercing instrument. In step 912, pressure is applied between the palm and the one or more fingers in order to cause pressure between the finger grip section engaging the feature with the matching feature of the body piercing instrument and the palm grip section engaging back edge of the main housing with the push support of the body piercing instrument to move the jaw and the main body of the cartridge together along the jaw track such that a post pierces the body part against the backing platform of the jaw.

This concludes the description including the preferred embodiments of the present invention. The foregoing description of the preferred embodiment of the invention has been presented for the purposes of illustration and description. It is not intended to be exhaustive or to limit the invention to the precise form disclosed. Many modifications and variations are possible in light of the above teaching.

It is intended that the scope of the invention be limited not by this detailed description, but rather by the claims appended hereto. The above specification, examples and data provide a complete description of the manufacture and use of the apparatus and method of the invention. Since many embodiments of the invention can be made without departing from the scope of the invention, the invention resides in the claims hereinafter appended.

What is claimed is:

1. An apparatus, comprising a body piercing instrument cartridge having: a main housing having a back edge for engaging a body piercing instrument, the body piercing instrument comprising a finger grip section and a palm grip section slidably engaged such that the back edge of the main housing is capable of engaging a push support rigidly coupled to the palm grip section; a post holder supporting a post and slidably engaged with a post holder track within the main housing; and a jaw slidably engaged into a jaw track of the main housing, the jaw track parallel to the post holder track, and the jaw includes a feature for engaging a matching feature rigidly coupled to the finger grip section of the body piercing instrument where the feature of the jaw is disposed back from an end of the jaw such that the end of the jaw extends beyond a forward extension from the finger grip section of the body piercing instrument; wherein the jaw supports a backing platform for piercing a body part with the post as the jaw and main housing are moved together along the jaw track by pressure applied between the finger grip section engaging the feature with the matching feature of the body piercing instrument and the palm grip section engaging the back edge of the main housing with the push support of the body piercing instrument and wherein both the end of the jaw extends beyond the forward extension from the finger grip section of the body piercing instrument and the main housing, the palm grip section of the body piercing instrument, and the post holder do not move relative to one another as the jaw and the main housing are moved for piercing the body part with the post.

2. The apparatus of claim 1, further comprising the body piercing instrument wherein the forward extension from the finger grip section is tapered to a blunt point.

3. The apparatus of claim 2, wherein the blunt point of the forward extension comprises a lip such that the feature of the jaw comprises a transverse slot and the matching feature of the finger grip section comprises the lip.

4. The apparatus of claim 1, wherein the post holder includes separate portions held together to support the post while slidably engaged with the post holder track within the main housing such that the separate portions fall away to release the post after exiting the post holder track.

5. The apparatus of claim 1, further comprising the body piercing instrument wherein the body piercing instrument comprises a spring disposed between the finger grip section and the palm grip section to oppose moving the jaw and main housing together after the back edge of the main housing engages the push support of the palm grip section and the feature of the jaw engages the matching feature of the finger grip section.

6. The apparatus of claim 5, wherein the jaw includes a push catch for sliding past the post holder as the jaw and main housing are moved together during piercing to engage a back end of the post holder and push the post holder out of the post holder track as the spring forces the jaw and main housing apart after piercing.

7. The apparatus of claim 1, wherein the backing platform comprises a surface for supporting a user body part in an area around a back side of a piercing location and a hole therethough aligned with the post.

8. The apparatus of claim 7, wherein the hole therethough is vertically elongated to accommodate vertical movement by the post during piercing.

9. The apparatus of claim 1, wherein the post comprises a conical barb for clutchless piercing.

10. The apparatus of claim 1, wherein the backing platform houses a clutch disposed in a vertical slot to engage the post during piercing and then slide out of the vertical slot.

11. The apparatus of claim 1, further comprising the body piercing instrument wherein the finger grip section and the palm grip section each comprise a series of bumps or ridges for improving grip.

12. A method of piercing a body part, comprising the steps of: engaging a back edge of a main housing of a body piercing cartridge with a push support of a body piercing instrument, where the body piercing instrument comprises a finger grip section slidably engaged with a palm grip section and the push support is rigidly coupled to the palm grip section and where the body piercing cartridge comprises a jaw slidably engaged into a jaw track of the main housing and a post holder supporting a post is slidably engaged in a post holder track within the main housing, the jaw track being parallel to the post holder track; engaging a feature on the jaw of the body piercing cartridge with a matching feature rigidly coupled to the finger grip section of the body piercing instrument where the feature of the jaw is disposed back from an end of the jaw such that the end of the jaw extends beyond a forward extension from the finger grip section of the body piercing instrument; disposing a body part against a backing platform of the jaw with the body part between the jaw and the post; disposing one or more fingers of a user's hand across the finger grip section of the body piercing instrument; disposing a palm of the user's hand across the palm grip section of the body piercing instrument; and applying pressure between the palm and the one or more fingers in order to cause pressure between the finger grip section engaging the feature with the matching feature of the body piercing instrument and the palm grip section engaging the back edge of the main housing with the push support of the body piercing instrument to move the jaw and the main body of the cartridge together along the jaw track such that the post pierces the body part against the backing platform of the jaw; wherein both the end of the jaw extends beyond the forward extension from the finger grip section of the body piercing instrument and the main housing, the palm grip section of the body piercing instrument, and the post holder do not move relative to one another as the jaw and the main housing are moved for piercing the body part with the post.

13. The method of claim 12, wherein the forward extension from the finger grip section is tapered to a blunt point.

14. The method of claim 13, wherein the blunt point of the forward extension comprises a lip such that the feature of the jaw comprises a transverse slot and the matching feature of the finger grip section comprises the lip.

15. The method of claim 12, wherein the post holder includes separate portions held together to support the post while slidably engaged with the post holder track within the main housing such that the separate portions fall away to release the post after exiting the post holder track.

16. The method of claim 12, wherein the body piercing instrument comprises a spring disposed between the finger grip section and the palm grip section to oppose to moving the jaw and main housing together after the back edge of the main housing engages the push support of the palm grip section and the feature of the jaw engages the matching feature of the finger grip section.

17. The method of claim 16, wherein the jaw includes a push catch for sliding past the post holder as the jaw and main housing are moved together during piercing to engage a back end of the post holder and push the post holder out of the post holder track as the spring forces the jaw and main housing apart after piercing.

18. The method of claim 12, wherein the post comprises a conical barb for clutchless piercing.

19. A body piercing system, comprising: a body piercing cartridge including a main housing, a jaw slidably engaged into a jaw track of the main housing, and a post holder supporting a post and slidably engaged with the main housing with a post holder track, the jaw track parallel to the post holder track; and a body piercing instrument including a finger grip section and a palm grip section slidably engaged where a push support is rigidly coupled to the palm grip section of the body piercing instrument; wherein the jaw includes a feature for engaging a matching feature rigidly coupled to the finger grip section of the body piercing instrument and the feature of the jaw is disposed back from a front end of the jaw such that the front end of the jaw extends beyond a forward extension from the finger grip section of the body piercing instrument; and wherein the jaw supports a backing platform for piercing a body part with the post as the jaw and main housing are moved together along the jaw track by pressure applied between the finger grip section engaging the feature with the matching feature of the body piercing instrument and the palm grip section engaging the back edge of the main housing with the push support of the body piercing instrument and wherein both the end of the jaw extends beyond the forward extension from the finger grip section of the body piercing instrument and the main housing, the palm grip section of the body piercing instrument, and the post holder do not move relative to one another as the jaw and the main housing are moved for piercing the body part with the post.

20. The body piercing system of claim 19, wherein the forward extension from the finger grip section is tapered to a blunt point and the blunt point of the forward extension comprises a lip such that the feature of the jaw comprises a transverse slot and the matching feature of the finger grip section comprises the lip.

* * * * *